US005351840A

United States Patent [19]

Visco et al.

[11] Patent Number: 5,351,840

[45] Date of Patent: Oct. 4, 1994

[54] COMBINED CHALK AND ERASER DISPENSER

[75] Inventors: Louis A. Visco, Marlton; Arthur Gravina, Medford, both of N.J.

[73] Assignee: University of Pennsylvania, Philadelphia, Pa.

[21] Appl. No.: 940,250

[22] Filed: Sep. 4, 1992

[51] Int. Cl.[5] ..... A47F 7/00

[52] U.S. Cl. ..... 211/69.1; 211/59.2

[58] Field of Search ..... 211/69.1, 60.1, 59.2

[56] References Cited

U.S. PATENT DOCUMENTS

| | | | |
|---|---|---|---|
| D. 162,809 | 4/1951 | Gay | 211/59.2 X |
| 1,140,822 | 5/1915 | Hirshfeld | 211/59.2 X |
| 3,287,073 | 11/1966 | Holtkamp | 211/59.2 X |
| 3,744,866 | 7/1973 | Cook | 211/59.2 X |
| 3,957,174 | 5/1976 | Palamara | 211/59.2 X |
| 4,881,787 | 11/1989 | King et al. | 211/59.2 X |

*Primary Examiner*—Ramon O. Ramirez
*Assistant Examiner*—Sarah A. Lechok
*Attorney, Agent, or Firm*—James Albert Drobile; Robert E. Rosenthal

[57] ABSTRACT

A combined chalk and chalkboard eraser dispenser includes a vertical planar rear wall, a vertical planar front wall spaced forward from the rear wall by approximately the height of a standard blackboard eraser, and a horizontal planar bottom ledge projecting forward from the lower edge of the rear wall, an eraser dispenser opening being defined between a lower edge of the front wall and a forward edge of the bottom ledge. Chalk receptacles are substantially in the form of rectangular boxes having a open horizontal forward face. The depth of the chalk dispenser is preferably slightly less than the length of a standard piece of chalk.

8 Claims, 3 Drawing Sheets

COMBINED CHALK AND ERASER DISPENSER

BACKGROUND OF THE INVENTION

This invention relates to dispensers for articles, and in particular to dispensers for blackboard chalk and blackboard erasers.

The conventional chalkboard or blackboard, of slate or similar material, is ubiquitous as a writing surface in classrooms and lecture halls in educational institutions from elementary school to university level. The markers for chalkboards are generally solid, cylindrical pieces of chalk. Erasers, typically of felt with a rigid backing, and generally rectangular and of a size convenient to be held in the hand, are provided for erasing chalk markings from chalkboards.

The maintenance of a supply of fresh pieces of chalk and clean erasers is essential to successful use of the conventional chalkboard. Typically, there is provided at the lower edge of the chalkboard a horizonal ledge projecting from the wall. Chalk pieces and erasers are conventionally maintained on the ledge between uses. However, the conventional ledge is not desirable for storage of either chalk or erasers.

Pieces of chalk are quickly used up, or broken into pieces too small to be used. In a typical classroom or lecture hall, there may be, on any given day, several hours of lectures or classes in which the instructor makes extensive use of chalk. The number of fresh pieces of chalk required in a single day may accordingly be substantial. As a result, a lecturer must frequently obtain a fresh piece of chalk from the ledge. As the ledge is generally several feet in length, the instructor must use valuable class time to locate the fresh chalk along the ledge. This also interrupts the thought process of the instructor. In addition, the ledge is not well-designed to store a large number of pieces of chalk, as chalk cannot be stacked in a stable manner on the ledge. A box of chalk can easily fall off the ledge, thereby breaking the pieces of chalk in the box.

Nor is the conventional ledge adapted to maintaining a supply of clean erasers ready for use. Chalk dust from the act of writing on the blackboard, from erasing of chalk markings on the blackboard, and from breaking of chalk, tends to accumulate in the ledge. As a result, the erasing surfaces of the erasers become soiled with chalk dust. When soiled erasers are used, a film of chalk dust is deposited on the blackboard, which reduces the contrast between the chalk and the blackboard, and makes writing difficult to see.

When confronted with a soiled eraser, an instructor will frequently strike the eraser against the classroom wall adjacent to the blackboard. While this action results in a slightly-cleaner eraser, additional maintenance costs are in curred in cleaning the chalk dust from the walls. The chalk dust also falls on floors, and can enter the ventilation system. As a result, additional expense is incurred in cleaning the floors, and in more frequent replacement of filters in the ventilation system.

It is accordingly an object of this invention to provide a holder and dispenser for chalk and chalkboard erasers for classroom and lecture hall use.

Additional objects and advantages of the invention will become apparent from the detailed description of a preferred embodiment which follows.

SUMMARY OF THE INVENTION

A combined chalk and eraser dispenser includes means for retaining a plurality of conventional, substantially rectangular chalkboard erasers of a selected eraser size in a vertical stack, the retaining means having a dispensing opening defined in a lower, forward portion thereof, and a chalk receptacle for chalk pieces of a selected chalk length attached to the eraser retaining means, the chalk receptacle including a rear vertical wall and a forward opening, the distance from the rear wall to the forward opening being slightly less than the selected chalk length.

A combined holder and dispenser for rectangular chalkboard erasers of a selected eraser size and markers of selected marker length includes a vertical planar rear wall, a vertical, planar forward wall, spaced forward from the vertical planar rear wall by at least, and not substantially more than, the height of an eraser of the selected eraser size, a horizontal bottom ledge projecting forward of the rear wall, a dispensing opening being defined intermediate the forward wall and the ledge, and a chalk receptacle rigidly attached to and extending forwardly of the rear wall, the chalk receptacle having a forward opening a selected distance forward of the rear wall.

DETAILED DESCRIPTION OF A PREFERRED EMBODIMENT

Figure 1:
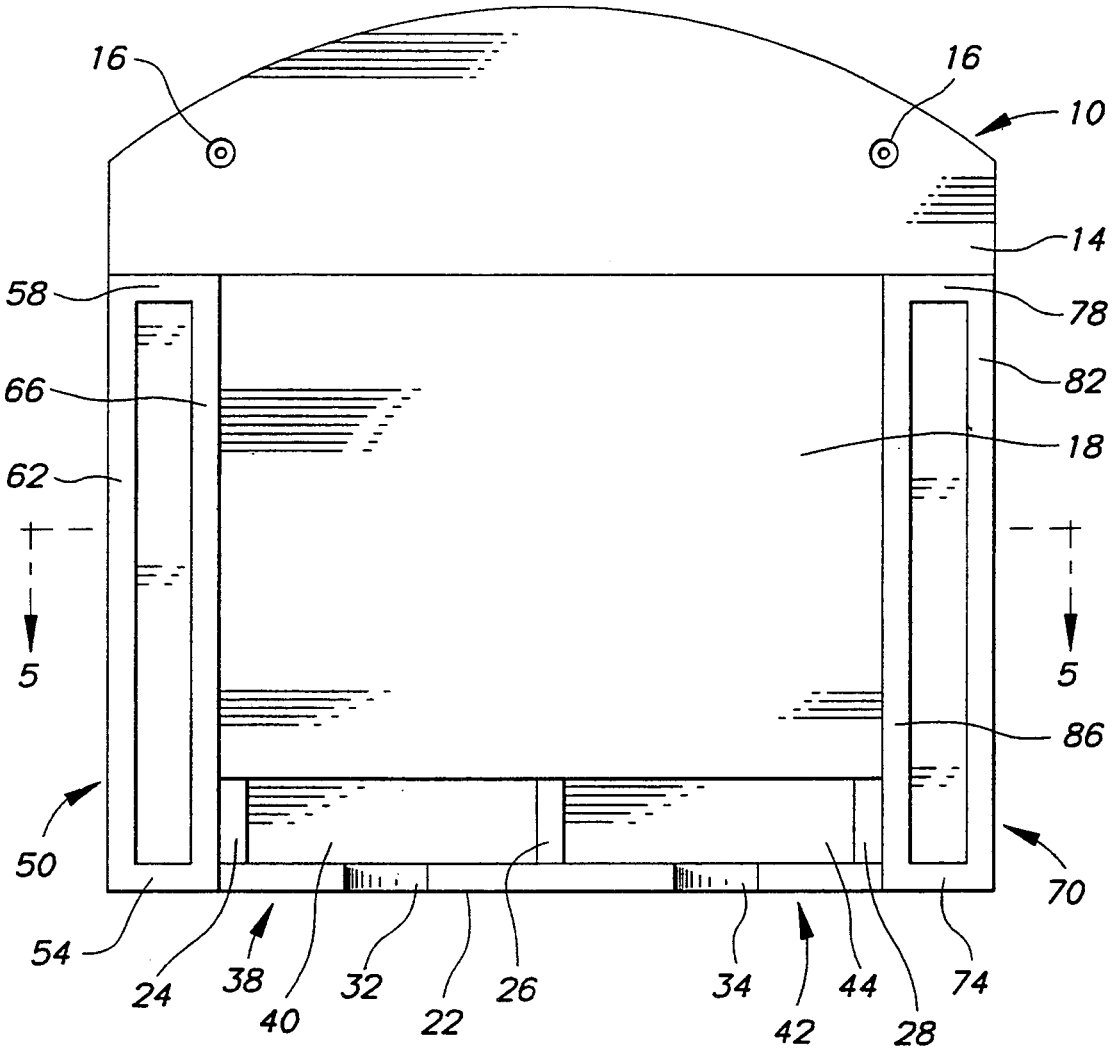
FIG. 1 is a front elevational view of an article according to the invention.
Figure 2:
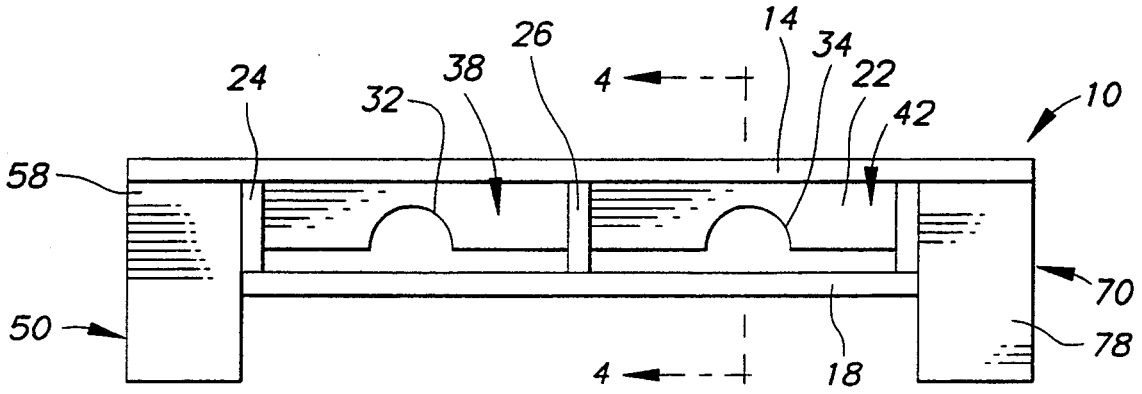
FIG. 2 is a top elevational view of an article according to the invention.
Figure 3:
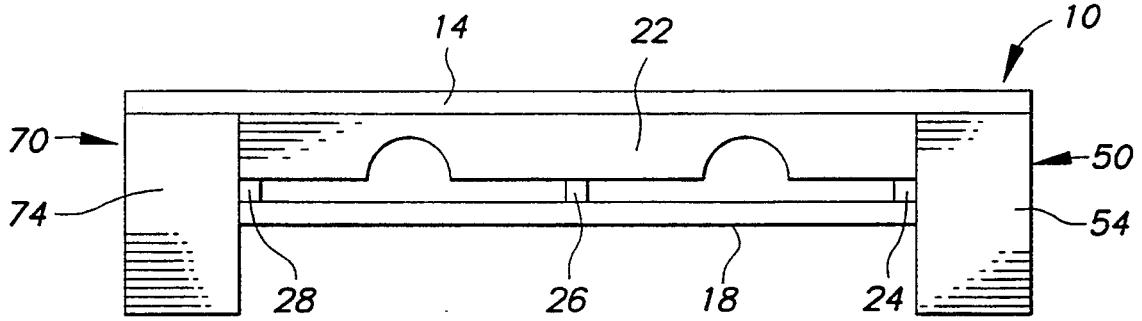
FIG. 3 is a bottom elevational view of an article according to the invention.
Figure 4:
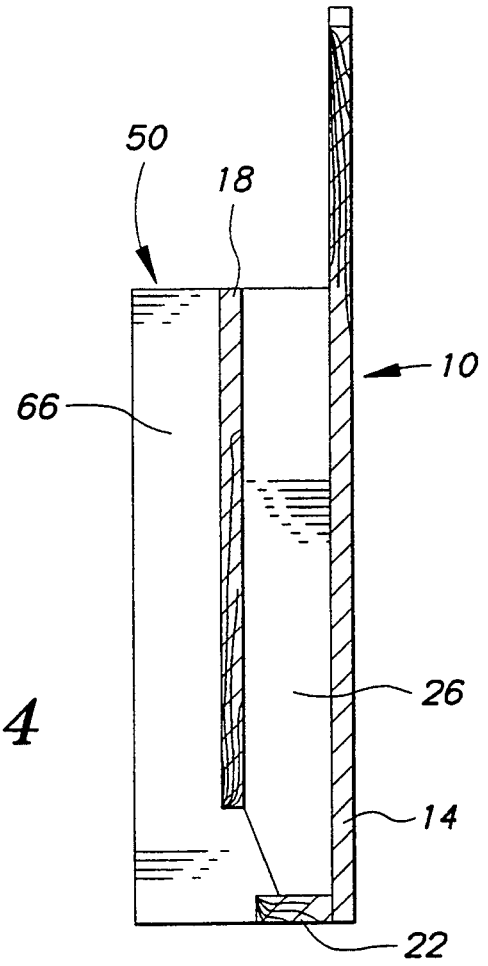
FIG. 4 is a cross-section of an article according to the invention taken along line 4—4 of FIG. 2.
Figure 5:
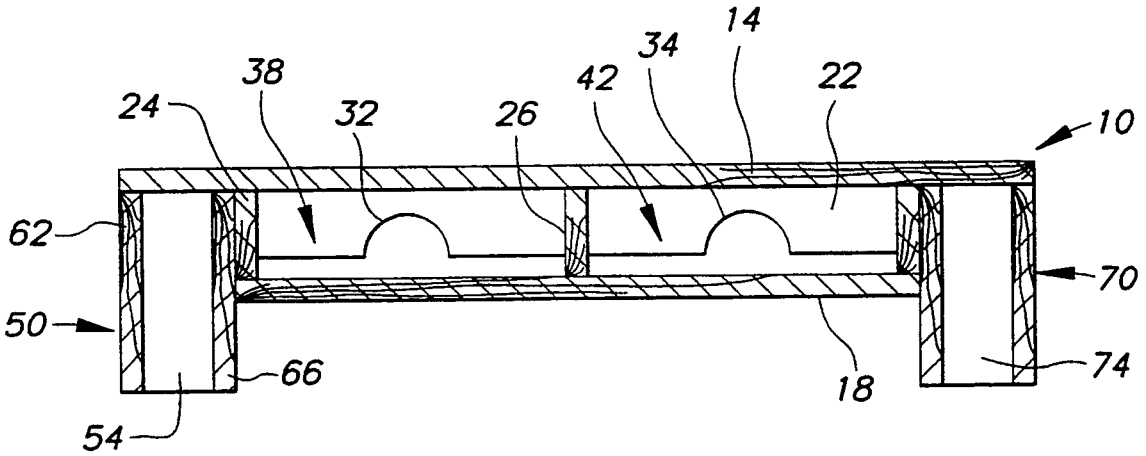
FIG. 5 is a cross-section of an article according to the invention taken along line 5—5 of FIG. 1.

Referring generally to the figures, there is depicted a combined eraser and chalk holder and dispenser unit 10 according to the invention. Unit 10 includes first eraser dispenser 38, second eraser dispenser 42, first chalk holder 50 and second chalk holder 70. Unit 10 has a substantially rectangular vertical planar rear wall 14, and a substantially rectangular planar vertical front wall 18 spaced forward a selected distance from rear wall 14. A vertical partition wall 26 is disposed at right angles to rear wall 14 and front wall 18 intermediate a forward face of rear wall 14 and a rear face of front wall 18. Vertical walls 24, 28 are disposed parallel to partition wall 26 intermediate rear wall 14 and front wall 18 at outer sides of first eraser dispenser 38 and second eraser dispenser 42, respectively. A substantially horizonal planar bottom ledge 22 is disposed projecting forward from a lower portion of rear wall 14.

First eraser dispenser 38 is defined by a portion of rear wall 14, a portion of front wall 18, vertical partition 26, vertical wall 24, and bottom ledge 22. First eraser dispenser 38 is a substantially rectangular cavity, open at the top, and having an eraser dispenser opening 40 defined in a lower, forward portion thereof. The horizontal lower edge of front wall 18 is a selected vertical distance above the upper surface of bottom ledge 22. This vertical gap defines eraser dispenser opening 40 in first eraser dispenser 38. In addition, the depth of bottom ledge 22 is preferably slightly less than the horizontal distance between the forward face of rear wall 14 and the rear face of front wall 18. The vertical distance between the upper surface of bottom ledge 22 and the lower edge of rear wall 14 is preferably slightly less than the width of a conventional eraser for which first dispenser 38 is designed. The horizontal distance between the forward face of rear wall 14 and the rear face of front wall 18 is preferably slightly more than the height of a conventional rectangular blackboard eraser which is to be held in holder 10. The distance between the forward face of rear wall 14 and the rear face of front wall 18, or the depth of first eraser dispenser 38, should be sufficiently greater than the height of such eraser that the eraser can freely fall between rear wall 14 and front wall 18. However, the depth should not be so great that the eraser can rotate about a horizontal axis while in first eraser dispenser 38. The horizontal distance between the inner face of vertical wall 24 and vertical partition 26 should be slightly greater than the length of the conventional eraser to be disposed in first eraser dispenser 38. By way of example only, for storing and dispensing erasers having a length of about 5 inches, a width of about 2 inches, and height of between about 1 inch and about $1\frac{3}{8}$ inches, the horizontal distance between rear wall 14 and front wall 18 may be $1\frac{1}{2}$ inches; the width of dispenser 38 may be $5\frac{1}{4}$ inches; the vertical distance between the lower edge of front wall 18 and the top of ledge 22 may be about $1\frac{3}{4}$ inches; and the depth of ledge 22 may be about $1\frac{1}{4}$ inches. Thus an eraser dispenser having the above dimensions is adapted to store and dispense erasers of a selected eraser size of about 5 inches by 2 inches by 1 to $1\frac{3}{4}$ inches. It will be understood that the selected eraser size may be a selected range of eraser sizes.

First eraser dispenser 38 is used as follows. A stack of conventional erasers is placed through the top opening into first eraser dispenser 38. Each eraser is placed with a long side downward, and preferably with its rigid backing facing forward. Rear wall 14, front wall 18, partition 26 and wall 24 serve to maintain the erasers in a vertical stack, with the bottom eraser in the stack resting on ledge 22. The erasers are preferably clean erasers, and may be, for example, placed in first eraser dispenser 38 at the beginning of the day. As instructors require clean erasers, the erasers may be removed one-by-one from first eraser dispenser 38 through dispensing opening 40. The dimensions of the eraser dispensing opening 40 are such that erasers can easily be removed one-by-one. However, as the height of dispensing opening 40 is less than the width of the erasers, erasers will not tend to fall out. Notch 32 provided along the forward edge of bottom ledge 22 allows a user to place one or more fingers under the eraser to pull forward and push upward on the bottom eraser, to facilitate removing the eraser. After an eraser is removed, the next eraser in the stack drops to ledge 22.

Thus, a quantity of erasers can be maintained in a single location in a classroom. The erasers will not come in contact with chalk dust. As a result, classroom time will not be wasted while the instructor locates a clean eraser, or attempts to clean a soiled eraser. Erasers will not be cleaned on the walls of the room, thereby reducing cleaning expenses. As erasers will not be beaten on the walls, less dust will enter the ventilation system. Chalk dust will accordingly not be distributed throughout the building, and filters will not need to be replaced as frequently.

Second eraser dispenser 42 has substantially the same dimensions as first eraser dispenser 38. In the embodiment illustrated, second eraser dispenser 42 is provided so that adequate supply of erasers will be available. Of course, a dispenser according to the invention could be provided having only one eraser dispenser. The distance between vertical partition 26 and an inner face of second vertical wall 28 is slightly greater than the length of a conventional eraser to be disposed in second eraser dispenser 42. Second eraser dispenser 42 must have an open top and a dispensing opening 44 defined in a lower forward portion thereof for removal of erasers. Second notch 34 provided in forward edge of bottom ledge 22 is provided for easy removal of erasers from second eraser dispenser 42.

To either side of front wall 18 there is disposed projecting forward from rear wall 14, first chalk holder 50 and second chalk holder 70. First chalk holder 50 includes horizontal planar first chalk holder bottom 54 disposed at the lower edge of rear wall 14, and horizontal planar first chalk holder top 58 disposed above first chalk holder bottom 54 and projecting from vertical wall 14. First chalk holder 50 further includes first chalk holder outer wall 62 disposed along one side edge of rear wall 14 and attached at its upper and lower edges to first chalk holder top 58 and first chalk holder bottom 54 respectively, and substantially planar vertical first chalk holder inner wall 66 disposed parallel to first chalk holder outer wall 62 and attached at its upper and lower edges to first chalk holder top 58 and first chalk holder bottom 54, respectively, opposite to first chalk holder outer wall 62.

Second chalk holder 70 includes substantially horizontal planar second chalk holder bottom wall 74 projecting from a lower edge of rear wall 14, second chalk holder top 78 disposed directly above second chalk holder bottom 74 and projecting from rear wall 14, substantially planar vertical second chalk holder outer wall 82, attached at its upper and lower edges to second chalk holder top 78 and second chalk holder bottom 74, respectively, and along its rear edge to a side edge of rear wall 14, and substantially planar vertical second chalk holder inner wall 86 spaced inward from second chalk holder outer wall 82. Second chalk holder inner wall 86 is attached along its lower edge to second chalk holder bottom 74, along its upper edge to second chalk holder top 78 and along its rear edge to rear wall 14.

First chalk holder 50 and second chalk holder 70, as described above, are each substantially in the form of a rectangular box having a horizontal forward opening. It is preferable that the horizontal depth of first chalk holder 50 and second chalk holder 70 each be slightly less than the length of a standard piece of chalk which is intended for use in first chalk holder 50 and second chalk holder 70. As the depth of the chalk holders 50, 70 is less than the length of the such pieces of chalk, pieces of chalk will protrude slightly from chalk holders 50, 70 for easy removal. For pieces of chalk having a length of $3\frac{1}{4}$ inches, the horizontal distance between rear wall 14 and the front edge of each of first chalk holder bottom 54, first chalk holder top 58, first chalk holder outer wall 62, first chalk holder inner wall 66, second chalk holder bottom 74, second chalk holder top 78, second chalk holder outer wall 82, and second chalk holder inner wall 86, is preferably about 3 inches. The width of the chamber defined by each chalk dispenser 50, 70, may be, for example, about 1 inch, and the height of the chamber may be, for example, about 10 inches. As a conventional piece of chalk has a diameter of about $\frac{3}{8}$ inches, the capacity of chalk dispensers 50, 70, is substantial. The horizontal forward opening in chalk dispensers 50, 70 provides easy access to the chalk contained therein. In addition, maintenance personnel can, at a glance, see whether the supply of chalk is running low in a dispenser.

Unit 10 according to the invention may be constructed of wood or other appropriate material. For example, each piece may be constructed of plywood. The various planar pieces may be joined to one another by use of wood screws, nails, wood glue, and other conventional techniques. The unit 10 is preferably attached to a classroom wall by disposing an appropriate fastener through each of holes 16 provided through rear wall 14.

Thus, the invention provides in a single unit a convenient storage receptacle and dispenser for both erasers and chalk. Erasers are maintained in the receptacle and free from chalk dust, until the erasers are to be used. Erasers may conveniently be removed one-by-one from the unit. The chalk is maintained in a convenient receptacle. Fresh pieces of chalk can be removed easily by an instructor whenever desired.

The unit 10 of the invention has a larger capacity, for both chalk and erasers, than a conventional ledge. As a result, supplies need not be replenished as frequently. In addition, as chalk need not be provided in individual boxes, which typically hold a dozen pieces of chalk, an institution using units according to the invention can purchase chalk in bulk, rather than in boxes, resulting in cost savings.

It will be appreciated that there are considerable variations that can be accomplished in an article of the invention without departing from its scope. As a result, although a preferred embodiment of an article according to the invention has been described above, it is emphasized that the invention is not limited to a preferred embodiment, and there exist other alternative embodiments that are fully encompassed within the invention's scope, which is intended to be limited only by the scope of the appended claims.

What is claimed is:

1. A combined chalk and eraser dispenser, comprising:

(a) means for retaining a plurality of conventional, substantially rectangular chalkboard erasers of a selected eraser size in a vertical stack, said retaining means having a dispensing opening defined in a lower, forward portion thereof; and (b) a chalk receptacle for chalk pieces of a selected chalk length attached to said eraser retaining means, said chalk receptacle comprising a rear vertical wall, opposite side walls, and a bottom wall, said side walls and said bottom walls defining a forward opening, the width of said forward opening being equal to the horizontal distance between said side walls, the surface of said bottom wall defining the bottom of said forward opening, the distance from said rear wall to said forward opening being slightly less than said selected chalk length.

2. An article as recited in claim 1, wherein said eraser retaining means comprises a rear vertical member, a forward vertical member spaced a selected distance forward of said rear vertical member, and a horizontal bottom supporting member projecting forward from said rear vertical member.

3. An article as recited in claim 2, wherein an upper surface of said bottom supporting member is spaced vertically downward from a lower edge of said forward vertical member to define said dispensing opening.

4. An article as recited in claim 3, wherein said bottom supporting member is a horizontal planar ledge having a depth less than a distance between said forward vertical member and said rear vertical member.

5. An article as recited in claim 4, wherein a vertical distance between a lower edge of said forward vertical member and said bottom supporting member is a selected distance less than the width of a blackboard eraser of said selected eraser size.

6. An article as recited in claim 4, wherein said bottom supporting member has a notch defined in a forward edge thereof.

7. An article as recited in claim 1, wherein said side walls of said chalk receptacle are vertical and said bottom wall is horizontal and planar and disposed intermediate said vertical side walls.

8. A combined holder and dispenser for rectangular chalkboard erasers of a selected eraser size and markers of selected marker length, comprising:

(a) a vertical, planar rear wall;

(b) a vertical, planar forward wall, spaced forward from said vertical planar rear wall by at least, and not substantially more than, the height of an eraser of said selected eraser size;

(c) a horizontal bottom ledge projecting forward of said rear wall, a dispensing opening being defined intermediate said forward wall and said ledge; and (d) a chalk receptacle rigidly attached to and extending forwardly of said rear wall, said chalk receptacle having a forward opening a selected distance forward of said rear well, said chalk receptacle comprising a rear vertical wall, opposite side walls, and a bottom wall, said side walls and said bottom wall defining a forward opening, the width of said forward opening being equal to the distance between said opposite side walls, the distance between said rear wall of said chalk receptacle and said forward opening being slightly less than said selected marker length.

* * * * *